US006240565B1

(12) United States Patent
Spear

(10) Patent No.: US 6,240,565 B1
(45) Date of Patent: Jun. 5, 2001

(54) WAITER'S HOT PLATE ARM-SHIELD GAUNTLET

(76) Inventor: Helen Terry Spear, 1001 Cornish Dr., Encinitas, CA (US) 92024

( * ) Notice: Subject to any disclaimer, the term of this patent is extended or adjusted under 35 U.S.C. 154(b) by 0 days.

(21) Appl. No.: 09/431,125

(22) Filed: Nov. 1, 1999

(51) Int. Cl.[7] ..... A41D 19/00

(52) U.S. Cl. ..... 2/158; 2/16; 2/81

(58) Field of Search ..... 2/16, 20, 59, 81, 2/158, 159, 161.1, 161.3, 161.8, 163, 164, 167, 458, 907, 161.6; D29/118, 119; 602/21, 22, 62

(56) References Cited

U.S. PATENT DOCUMENTS

| | | | | |
|---|---|---|---|---|
| D. 258,625 | | 3/1981 | Sheridan . | |
| D. 300,676 | | 4/1989 | Price . | |
| D. 381,130 | * | 7/1997 | Anderson | D29/119 |
| 1,117,077 | * | 11/1914 | Mooney | 2/16 |
| 2,304,137 | | 12/1942 | Peakes . | |
| 2,323,136 | | 6/1943 | Johanson . | |
| 2,735,108 | * | 2/1956 | Cremer | 2/158 |
| 2,810,131 | * | 10/1957 | Kogut | 2/158 |
| 2,889,556 | * | 6/1959 | Mehler | 2/158 |
| 2,905,946 | | 9/1959 | Goldsmith . | |
| 2,937,379 | * | 5/1960 | Mackay et al. | 2/158 |
| 3,327,320 | * | 6/1967 | Forsyth | 2/16 |
| 3,889,297 | * | 6/1975 | Jarboe et al. | 2/16 |
| 4,628,544 | | 12/1986 | Erickson . | |
| 4,942,624 | * | 7/1990 | Cho | 2/16 |
| 5,083,314 | * | 1/1992 | Andujar | 2/18 |
| 5,335,888 | | 8/1994 | Thomsen . | |
| 5,592,694 | | 1/1997 | Yewer, Jr. . | |
| 5,644,793 | | 7/1997 | Lahaussois . | |
| 5,715,535 | | 2/1998 | Hamilton . | |
| 5,865,775 | * | 2/1999 | Peoples et al. | 602/20 |

* cited by examiner

*Primary Examiner*—John J. Calvert
*Assistant Examiner*—Tejash Patel
(74) *Attorney, Agent, or Firm*—Donald Wenskay

(57) ABSTRACT

A conveniently deployable arm-shield safety-pad uniquely configured to protect a professional waiter's arm-surface from injurious heat-exposure to hot dinner-plates during routine arm-borne restaurant serving procedures. The fixed inward-end of the elongated arm-shield is secured to one's forearm via a hook-&-loop fastening-strap; -the opposite outward-end having convenient finger-tip and thump retention-pockets, facilitating quick and easy roll-out deployment of the normally rolled-up protective pad material. Also set forth is a preferred flexile-laminate material employing at least one layer of reflective Mylar-film material; and including an outwardly exposed layer of high-coefficient of friction surfacing material,—serving to reduce slippage of the balanced dinner-plates. Once the waiter has completed a serving procedure, the finger-tips and thumb are withdrawn from their retention-pockets, enabling the arm-shield to be readily rolled-up one's arm into a compact stow-roll ready for subsequent reuse.

23 Claims, 1 Drawing Sheet

10'
10"
12
26
29
11

22
13'
13"
25
11'
11
28

30a
22
24
30b
10
30c
16
29
26
25
11
23
17
14'
20'
11
20
18
11'
16
21
14"
13"
23
17
30d
18

25'
25
20'
13'
22
21
14"
11'
11
14
14'

15"
29'
15'
15
23
22

22
15"
29'
15'
15
19
22
21
14"
23

WAITER'S HOT PLATE ARM-SHIELD GAUNTLET

I.) BACKGROUND OF THE INVENTION

1. Field of Invention

This invention relates to methods of attaching devices serving to protect the forearm from possible injury, especially that caused by a hot object being placed against the forearm; and more specifically, it relates to gauntlet like apparatus employed by a waiter to ward off the effects of hot-plates or a hot serving-tray per'se.

2. Relevant Prior-Art

Background research discovery provides some prior patent-art regarded as germane to this disclosure, chronologically for example U.S. Pat. No. 2,304,137 (filed: December 1932) contemplates a mustard-gas warfare hand-protective glove, in which the thumb and the four opposed digits are shown (albeit not claimed) divided into three discrete portions;—that is, all five digits are cooperative yet the thumb is isolated, as is the index-finger discretely isolated from the three last fingers (ref. FIG. 3). However, this inventor could had not ventured any thought toward using the glove for the serving of a hot-tray or hot-plates, ventured any thought toward using the glove for the serving of a hot-tray or hot-plates, especially since the materials from which the glove were fabricated gave no consideration to the presence of extraordinary heat,—only protection from warfare-chemicals considered potentially injurious to the wearer's skin. Similarly, in U.S. Pat. No. 2,323,136 (filed: November 1941) is shown a somewhat general hand-mitten type of glove;—here again, in (ref. FIG. 3) which the inventor prefers the thumb and index-finger (fore-finger) be descretely isolated from the other three together protected fingers. Moreover, In U.S. Pat. No. D-258,625 (filed: January 1979) is shown a heat-protective arm and hand glove for hot-food service; wherein the thumb, index-finger, and three remaining fingers are received in discrete digit-receptacles formed integrally thereto. The design FIGS. 2 & 5 reveal that the entire hand and forearm is enveloped by the conventional glove construction, wherein the hand is thus inserted only from the aftward end of the glove.

In U.S. Pat. No. 2,905,946 (filed: February 1958) is shown (ref. FIGS. 1&2) a heat-insulative potholder type hand-glove, which employed a particular grid-pattern of said embossed construction in combination with an aluminum impregnated plastic coated fabric; said to render at least the palm interfacing side of the glove somewhat reflective of heat emanating from a utensil such as a hot frying-pan. However, while the insulation padding is practical for a mitten type of hand-glove, it would become unmanageable bulky if attempt were made to subject such bulky padding (as exhibited in FIGS. 9–12) to a tightly rolled coil of material.

In U.S. Pat. No. 4,628,544 (filed: April 1985) is shown a server's (waiter's) single gauntlet apparatus, having an alligator like (FIG. 2) forward-mouth portion which is transversely occluded at the throat region, thereby enabling user's thumb (FIG. 1) be protectively received into the upper-mouth portion while user's remaining four fingers are protectively received into a discretely bifurcated lower-mouth receptacle portion (FIG. 4). Noting particularly that the aftward portion of the gauntlet merely lays unsecured above the aftregion of the forefarm; while forwardly, the dexterity of user's fingers relative to their thumb is flexially compromised whereby only one hot-plate can be carried within the grasping mouth of the gauntlet.

In U.S. Pat. No. D-300,676(filed: April 1986) is shown an open-ended padded-sleeve like forearm-protector, for which no purpose is stated; while in U.S. Pat. No. 5,644,793 (filed: February 1996) is shown an inexpensive disposable laminated-plastic sanitary forearm-sleevelet apparatus, which is made to be readily avulsed (torn away) from an extensive dispensing-roll of such devices. However, no provision is made for insulating heat from injuring the forearm over which the sleevelet is worn.

In U.S. Pat. No. 5,335,888 (filed: July 1992) is shown a forearm support-cradle apparatus, said for use in conjunction with extensive operation of a computer-mouse device;—which is essentially a linear U-shaped soft-foam channel provided with dual transverse forearm encircling loop-straps, serving to secure the cradle fast to the lower-side of user's forearm. The forward loop-strap is said to be elastic, while the aftward loop-strap is said to be made adjustable to the girth of user's aft-forearm region via a hook-&-loop type straping arrangement.

In U.S. Pat. No. 5,592,694 (filed: April 1995) is shown a flexible web-wrapping type of sports-glove (such as for bicycling, weight-lifting, water-skiing, etc.), which is installed by helically wrapping the wrist-panel portion about user's upper-hand, palm, and wrist region primarily; and is cited here primarily for the manner in which the opposed thumb is isolated from the cooperative fingers. However, as with all of the other known glove devices being discussed, there is no provision for readily removing one's digits from the forward-retention portions of the glove; nor is there anticipation toward conveniently stowing the glove article upon the immediate forearm.

Finally, in U.S. Pat. No. 5,715,535 (filed: July 1995) is shown a forearm apparatus for conveniently cradling a baby; which employs two padded-sleeve like portions, one encircling the aft-forearm, the other encircling the lower-upperarm, leaving the elbow region open. The apparatus is said to lend comfort to the parent holding an infant for long periods; thereby reducing fatigue. Accordingly, there is no thought given to protecting the forearm from heat; which is the primary purpose of the instant invention hereof.

Therefore, in full consideration of the preceding patent review, there is determined a need for an improved form of device to which these patents have been largely addressed. The instant inventor hereof believes their newly improved thermo-gauntlet device, commercially referred to as the ARMER-PAK™ Serving-glove, currently being developed for production under auspices of H. T. Spear-Mfg./Mkt. Co.,—exhibits certain advantages as shall be revealed in the subsequent portion of this instant disclosure.

II.) SUMMARY OF THE INVENTION

A.) In view of the foregoing discussion about the earlier invention art, it is therefore important to make it pellucid to others interested in the art that the object of this invention is to provide an improved forearm heat-shield capable of preventing injury to user's forearm, as is often caused by carrying of hot objects during table-service waitering of hot-plates; as is traditional practice among many professional waiters and waitresses in busy dining establishments. Carrying or toting of several hot plates in this studied manner serves to reduce the number of kitchen trips required to serve one or more customers generally at a so-called "family type restaurant" dinner-table, and the art is known to already employ so called gauntlet type heat-protective gloves capable of supporting several hot-plates or a hot-tray upon one's horizontally upheld forearm.

However, the prior-art has the prevailing problem of inconvenience, as may be observed during time-&-motion studies conducted to evaluate the efficiency of restaurant waitering procedures. Since the prior-art gauntlets tend to be somewhat bulky, most waiters do not choose to carry the device upon their person; hence, the protective gauntlet device may be inadvertently picked-up for use by a co-working waiter, or may be easily misplaced, in any case causing an annoyance to a hurried waiter needing its protection.

The "always ready" primary notion of my improved gauntlet or protective armlet. device, is to be embodied in such configuration as to facilitate convenient manual rolling-up into a compactly coiled pack secured neatly proximal one's aftward forearm region;—and hence available for immediate deployment forward along one's forearm whenever needed, thereby obviating a search for the whereabouts of a conventional heat-protective gauntlet.

Currently, about 40% of adults (aged 21–75) defray about 44% of their food-expended dollars on meals prepared away from home (up from 38% a decade ago); and about half of this expenditure is done at so-called "family restaurants", where multi-plate meals are served "hot" from the kitchen (the way customers like it). Hence, it has been determined there is a growing need for such an improved safety related product, significantly reducing worker-compensation as to worksite-injury liability.

B.) Another object of this invention disclosure is to set forth a waiter's hot-plate thermal-protection apparatus, preferably fabricated out of machine-sewn flexible laminate material; a first-side of which interfaces wearer's forearm and includes a contiguous forward-retention device employing users fingers and opposed thumb digets. The opposite second-side of the insulative material thereby essentially serving to directly interface any hot-plate being balanced upon the horizontally upheld forearm, and preferably includes a non-slip surface, such as matte-finish verses a slick gloss-finish, or possibly a surface of tactically textured rubberized nubbins for example; which higher coefficient-of-friction facilitates more stable balancing of hot dishes while walking to a serving site.

This forward-retention embodiment is preferably a pocket like formation having three cooperative albeit discrete parts, one receiving the opposable thumb, the second receiving the index-finger, the third receiving the remaining three fingers. In lieu of an occluded pocket formation for the user's digits, the forward-retention device may be embodied in an open-ended configuration tantamount to a cross-strap like web member arranged transverse to the axes of user's hand digits, whereby one opening thus receives the opposable thumb, a second opening receives the index-finger, and a third opening receives user's remaining three fingers.

A generic variation of the forward-retention configuration can be an abbreviated mitten like formation capable of receiving the opposable thumb in a first discrete receptacle, and the user's fingers in a wider receptacle. Again, in lieu of an occluded pocket formation for the user's hand digits, the forward-retention device may be embodied in an open-ended configuration tantamount to a cross-strap arranged transverse to the axes of user's hand digits; whereby the first opening receives the opposable thumb while the second opening receives user's remaining four fingers.

C.) Another object of this invention disclosure is to set forth the waiter's hot-plate thermal-protection gauntlet according to preceding items-A&B, wherein the flexible insulating material having described first and second sides is further arranged as to extend aftward from the forward-retention device to function cooperatively with an aftward-retention device. The aftward-retention device employs a loop-strap proximal user's elbow region by which to maintain secure attachment of the gauntlet in a particularly unique manner. During non-use of the gauntlet, the user can keep the gauntlet apparatus out of the way yet readily at hand, by simply withdrawing their hand digits (thumb and fingers) from the forward-retention provision, then with their other hand proceed manually rolling-up the flexible material into a compact coil for stowing upon the upper forearm region, where the coiled gauntlet is preferably held coiled via mating pads of hook-&-loop fastening material. My gauntlet is thus conveniently always "at the ready" for rapid redeployment when needed for a subsequent hot-plate serving task (or may be completely removed from the arm at the end of one's work-shift). Presently, the most preferred loop-strap embodiment is made as a short length of 1–2 inch wide band of elastic material to lend compliance, while employing an outer length of non-elastic strap material furnished with a strip-fastener (hook-&-loop type fastener) thereto, thus facilitating variable or finite adjustment of the loop-strap to a user's particular upper-forearm (ie- the aftward forearm portion) cross-sectional girth (circumference). If preferred the loop-strap can also employ a loop-buckle or the type enabling cinching-up of a permanent length of strap material, or can be made from an elastic (self-adjusting) strap material; or alternately, can employ a conventional commercially available male/snap-fastener at a free distal-end, so as to readily loop around one's upper-forearm region for attachment into one of a plurality of incrementally spaced apart mating female/snap-fastener units.

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the Claims section annexed hereto; and accordingly, a better understanding of the invention and the variant uses is intended, by reference to the drawings, which are considered as primarily exemplary and not to be therefore construed as restrictive in nature; wherein:

IV.) ITEMIZED NOMENCLATURE REFERENCES

Figures 1A, 1B, 2, 3, 4, 5, 6, 7:
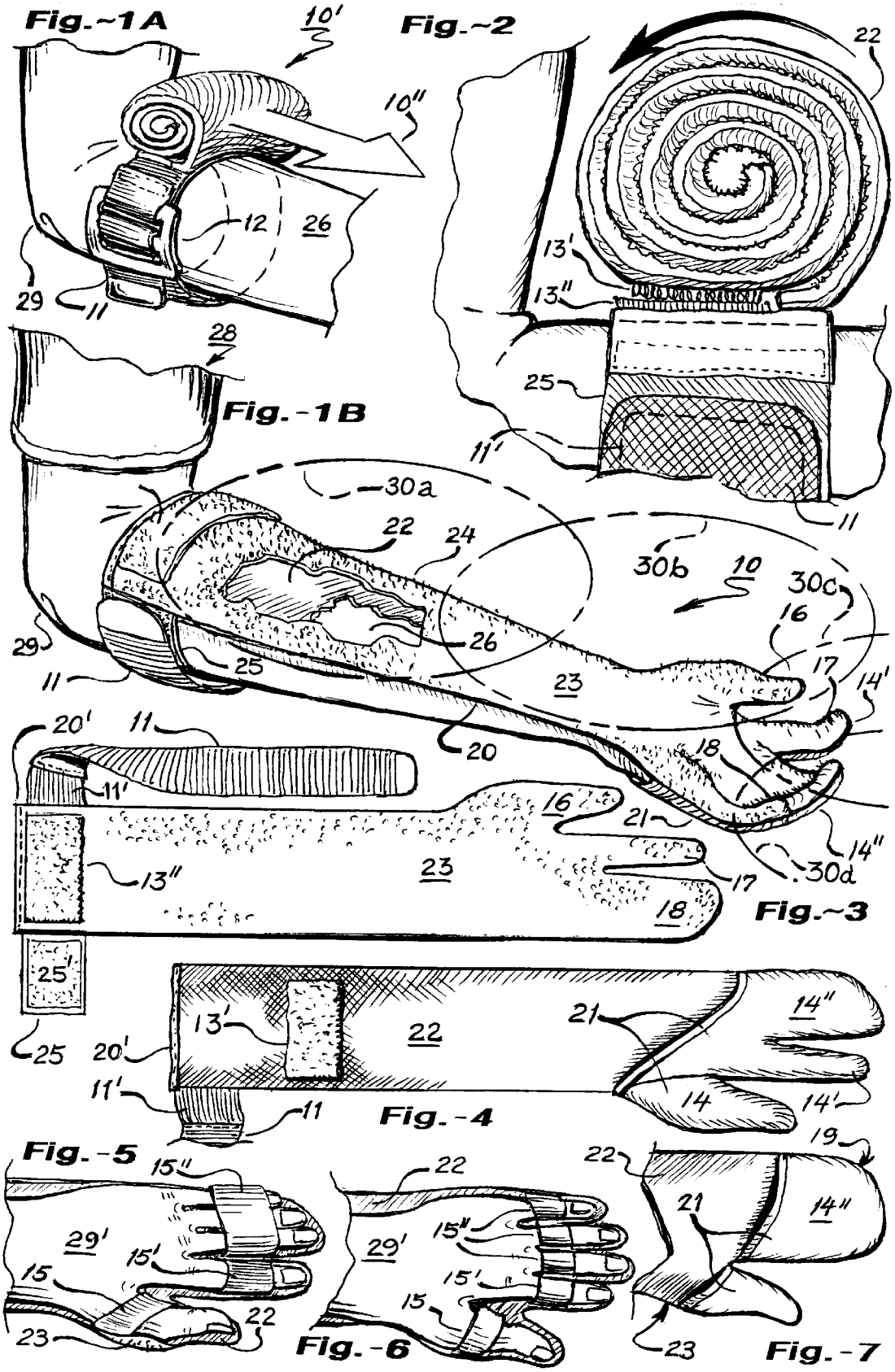
FIG. 1A, is the first of a fragmented two-sequence pictorial-view of a human-arm, demonstrating how my heat-shielding gauntlet apparatus appears secured at its fully retracted modality of operation.
FIG. 1B, is the second thereof a two-sequence pictorial-view demonstrating how my gauntlet apparatus appears when deployed into its forwardly extended modality of operation, while demonstrating supporting of an array of four phantom-outlined hot-plates.
FIG. 2, is a diagrammatic cross-sectional view taken along transverse-plane of reference 2:2 in FIG. 1A, revealing how my heat-shielding gauntlet apparatus is preferably stowed in its retracted-modality.
FIG. 3, is a flat-pattern plan-view showing the first-side of my heat-shielding gauntlet in its fully extended codition.
FIG. 4, is a matching flat-pattern plan-view overturned to reveal the second-side thereof, wherein is exhibited the preferred pocket like forward-retention arrangement.
FIG. 5, is a partial view thereof, showing a generic-variant forward-retention embodiment employing a through-hole cross-strap semi-separate digit arrangement.
FIG. 6, is another partial view thereof, showing a generic-variant separately-fingered digit forward-retention embodiment.
FIG. 7, is another partial view thereof, showing a generic-variant integrally-fingered, separate thumb, mitten-like forward-retention embodiment.

10/10', 10"—the overall gauntlet (uncoiled/coiled pack), action ref.—arrow
11, 11'—loop-strap (an aftward-retention device), elastic portion (optional)
12—loop-buckle
13'/13"—stow-pad/mating pad
14/14'/14"—digital pockets (thumb/forefinger/other fingers)
15/15'/15"—cross-strap portions (thumb/forefinger/other fingers)
16—thumb portion
17—index-finger portion
18—three-finger portion
19—four-finger portion
20,20'—general perimeter sewn-seam, aftward-edge sewn-seam
21—stretch-fabric
22—skin interfacing soft-material
23—heat-shielding material
24—friction-nibbs
25,25'—short-strap, mating hook-&-loop fastener-pad
26—upper-forearm surface
27—lower-forearm surface
28—human-arm, existing shirt-sleeve
29,29'—human-elbow, hand-backside (oppsite palm portion)
30/*a,b,c,d*- exemplified hot-plates

V.) DETAILED DESCRIPTION OF THE PREFERRED EMBODIMENTS

Initial reference is given by way of FIG. 1A, exhibiting how my heat-shielding gauntlet apparatus 10 appears when uniquely retracted into its convenient stow-mode of essential operation;—whereupon the provisional coiled-pack 10' may be removed entirely (and placed in the pocket of one's work-uniform), simply by avulsing (tearing away) the preferred hook-&-loop type strip-fastener portion 11 from mating portion 25. The companion sequence view FIG. 1B serves to demonstrate how my heat-shield gauntlet apparatus appears when deployed fully forward according to action ref.-arrow 10"(per FIG. 1A); while observing the enlarged detail of FIG. 2 reveals how compact the intimately coiled material appears when retracted according to FIG. 1A. It is preferred that the loop-strap simply wrap once around wearer's upper-forearm region 28 (proximal elbow 29), where it is adjustably attached to a short-strap portion 25 having a mating hook-&-loop portion 11'; thereby virtually obviating need for extraneous conventional loop-buckles 12 (or similar well known friction cinch-up type buckles, or snap-fastener devices).

Accordingly, when working at waitering tasks other than actively serving of meals, it can be seen (per FIG. 1A) how my heat-shielding gauntlet 10 is stowed completely out of the way;—yet is instantly releaseable from stow-position 10' by user manual urging the coiled gauntlet body portion's mating-pad 13" loose from its fixed stow-pad 13' mooring, and extending the gauntlet body forward (via action ref.-arrow 10" in FIG. 1A) by unrolling it toward the fully deployed position exhibited in FIG. 1B.

There remain subtle, however vital other differences which are to become herein more evident and understood as important improvements. For example, in FIG. 1B a server's right-arm 28 is demonstrating how my heat-shielding gauntlet 10 is conveniently held in operational position, preferably by the combination of the aftward-retention loop-strap device 11 (which was already secured in place during the stow-modality of operation) in opposition to the forward-retention devices preferably either comprising a digital pocket arrangement 14;—or, an essentially equivalent digital cross-strap arrangement 15 (shown in FIG. 5). Either of these forward-retention devices thus critically serving to keep the contiguous heat-shielding material oriented securely upon the up-turned body of the forearm at region 25, where it is seen how the exemplified phantom-outlined hot-plates 30/*a*&*b* are prevented from directly impinging upon the server's upturned upper 26 and lower 27 forearm surfaces.

The quality characteristics of the heat-shielding insulative material employed in my gauntlet apparatus is not so much an issue of this disclosure in of itself, in as much as selection of such materials, is subject to technological improvement as may possibly be forthcoming or determined by the manufacture as time goes by. However, since it is desirable to make the gauntlet's overall insulative material as thin as possible, so as to roll aftward into a compactly coiled package 10'; my presently most favored construction material for the forward-retention provision, is that of a Spandex® type stretch fabric by which to fashion the opposable thumb and finger digit pocket portions 14/14'/14". Accordingly, the alternately configured cross-straps 15/15'/15" of FIG. 5 can also be fashioned from Spandex® like material; or, merely made from conventional linear elastic-strap strap material sewn into seam 20. Note also, how the preferred semi-mitten like configuration enables convenient holding of an additional hot-plate 30/*c* between the thumb 16 and index-finger 17; plus, another hot-plate 30/*d* between the index-finger 17 and aggregate remaining fingers 18. Naturally if preferred, my heat-shielding gauntlet can be configured as a full array of independent albeit cooperatively acting hand digits as is alternately set forth in FIG. 6.

Also seen in FIG. 1B is a localized cut-away portion where the central forearm region is upturned, revealing how I presently prefer to employ a broadly compatible (as to skin sensitivity) high-quality cotton-quill type inwardly facing or interfacing-fabric material 22 (verses for example a more bulky cotton/terry-cloth type material) impinging directly against wearer's forearm skin surface 26, while immediately external (outwardly facing) thereto I prefer to employ a likewise flexible but more efficient heat-reflective or heat-insulative material (or combination of both characteristics) 23. The layers of material are thus preferably machine-sewn along general perimeter seam 20, in the professional manner whereby the raw-edges of the seam are turned internally, prior to final closure-stitching preferably located at the aftward most edge region 20'.

Although my heat-shielding gauntlet apparatus as substantially set forth in FIG. 1B, can be made as a universal "one-size fits all" type of gauntlet; it is preferred, owing to the substantial differences ranging between finger-span and forearm length, especially the span between the wearer's finger-tips and their elbow region (the forearm-girth differences are in any case easily accommodated by the variable-length loop-strap 11), that at least two sizes be made available for a more suitable fit. Additionally, study of FIG. 3&4 reveals how my heat-shielding gauntlet can be easily formed in a basic flat-pattern configuration; the forward-retention portion of which can be formed as shown, or if preferred may be configured according to exemplified alternate generic-variant embodiments set forth in FIGS. 5,6,7, which feature a cross-strap arrangement relative to the longitudinal-axes of the hand-digits. Note that while FIGS. 5&6 embodiments are more aerating of the hand-digits, they tend to be somewhat less protective as to vulnerablity to heat, as compared to the more enveloping iterations of FIG. 4&7. While the independently articulatable separate hand-digits of FIG. 6 are ultimately adaptable to the holding of plates, it has been found that the preferred triad-pocket configuration of FIG. 1B,3,4 are quite satisfactory, being readily receptive of one's hand-digits, while ultimately protective of the hand-digits; particularly as compared to the mitten-like embodiment of FIG. 7 which cannot not accommodate holding of the extra hot-plate 30*d*.

Thus, it is readily understood how the more preferred, and the generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended Claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

VI.) What is claimed of proprietary inventive origin is:

1. A waiter's hot-plate thermal-protection gauntlet comprising:

in deployed-modality: a flexible insulative member a first-side of which interfaces wearer's forearm and including a contiguous forward-retention portion means employing wearer's fingers and opposed thumb digits, the opposite second-side of said flexible insulative member serving to interface any hot-plate being balanced thereupon the horizontally upheld forearm, said flexible insulative member extending contiguously aftward to proximal wearer's elbow where is provided a cooperative aftward-retention portion;

in retracted modality, a retainer portion for mating with the attachment portion for releasably securing the flexible insulative member which is positionable proximal said wearer's elbow region to provide a compact configuration, when the flexible insulative member is retracted and the attachment and retainer portions are in mating relationship.

2. A waiter's thermal-protection gauntlet according to claim 1, wherein said forward-retention portion is a pocket like formation configured in three cooperative discrete parts, one receiving the opposable thumb, the second receiving the index-finger, the third receiving the remaining three fingers.

3. A waiter's thermal-protection gauntlet according to claim 1, wherein said forward-retention portion is open-ended tantamount to a cross-strap arranged transverse to the axes of users said digits, whereby one opening receives the opposable thumb, the second opening receives the index-finger, the third opening receives the remaining three fingers.

4. A waiter's thermal-protection gauntlet according to claim 1, wherein said forward-retention portion is an abbreviated mitten like formation configured to receive the opposable thumb in a first discrete receptacle, and users fingers in a wider receptacle.

5. A waiter's thermal-protection gauntlet according to claim 1, wherein said forward-retention portion includes an open-ended cross-strap arranged transverse to the axes of users said digits, whereby the first opening receives the opposable thumb, while the second opening receives users four fingers.

6. A waiter's thermal-protection gauntlet according to claim 1, wherein said aftward-retention portion is a loop-strap encircling users forearm and including a loop securing means.

7. An aftward-retention device according to claim 6, wherein said loop-strap securing means is an avulsable hook-&-loop strip-fastener arrangement facilitating finite adjustment to cross-sectional girth of users forearm.

8. An aftward-retention device according to claim 6, wherein said loop-strap securing means is a contiguous elastic-strap arrangement facilitating self-expansible adjustment to cross-sectional girth of users forearm.

9. A waiter's thermal-protective gauntlet according to claim 1, wherein said flexible insulative member first-side comprises a soft moisture absorbent cotton-quill material.

10. A waiter's thermal-protection gauntlet according to claim 1, wherein said flexible insulative member second-side comprises a material having a high coefficient of friction non-slip type surface, thereby facilitating a more effective balancing of dishes thereupon.

11. A waiter's thermal-protection gauntlet according to claim 1, wherein said forward-retention portion is made of a stretchable fabric material.

12. A waiter's thermal-protective gauntlet according to claim 1, wherein said flexible insulative member is patterned to the wearer's forearm so as to also wrap over the surface of the wearer's forearm extending aftward from trailing base of the wearer's thumb to the inner-elbow surface region thereby effectively protecting the wearer's forearm from the supported hot-plates.

13. A dual modality waiter's forearm supported hot-plate thermal-protector gauntlet comprising:

a flexible forearm protective member exhibiting in its deployed-modality a first-side for intimately interfacing wearer's digits, palm, and forearm surfaces and having an attachment portion thereon;

a finger-pocket portion readily receiving at least one of the wearer's digits, the second-side of the flexible forearm protective member providing a thermal protective function for direct supporting of hot-plates, said flexible forearm protective member extending contiguously aftward from the finger pocket portion to proximal wearer's elbow region;

a forearm aftward-retention portion securing said flexible forearm protective member to the wearer's forearm and having a retainer portion thereon;

said retainer portion releasably securing said flexible forearm protective member in a compact configuration proximal said wearer's elbow region when engaged with said attachment portion, whereby in an alternate retracted-modality of use, said flexible forearm protective member is conveniently withdrawn from protective function by removing the wearer's digits from said finger pocket portion forward-retentive means, and aftwardly retracting said material into a compact configuration proximate the wearer's elbow region whereby the material in a compact configuration is held fast out of the way and thereby ready for redeployment or complete removal.

14. A waiter's thermal-protection gauntlet according to claim 13, wherein said aftward-retention means is a loop-strap encircling users forearm and including a loop securing means.

15. An aftward-retention device according to claim 14, wherein said loop-strap securing means is a device selected from the following: an avulsable hook-&-loop strip-fastener arrangement, facilitating finite adjustment to cross-sectional girth of users forearm; or, a contiguous elastic-strap arrangement, facilitating self-expansible adjustment to cross-sectional girth of users forearm; or, a plurality of spaced apart male-&-female type snap-fasteners, facilitating incremental adjustment to cross-sectional girth of users forearm; or, a conventional cinch-buckle, facilitating finite adjustment to cross-sectional girth of users forearm.

16. A waiter's thermal-protection gauntlet according to claim 13, wherein said insulative material second-side is texturized with a high coefficient of friction non-slip type surface, thereby facilitating more effective balancing of dishes thereupon.

17. A waiter's thermal-protection gauntlet according to claim 13, wherein the portion of said forward-retention means interfacing with back-side of users hand digits is made of a stretchable fabric material.

18. A method of protecting a waiter's forearm from hot plates comprising:

attaching a flexible arm-shield including a loop-strap aftward-retention portion to the forearm proximal a wearer's elbow, retracting said flexible arm-shield rolled-up to a compact retracted-modality configuration;

at such time hot-plates are to be served by the wearer, extending said flexible arm-shield from said aftwardly retracted position, thereby presenting a contiguous first-side surface of the flexible arm-shield in contact with the wearer's forearm and palm surfaces, inserting the wearer's digits into the digit enclosing portions of the flexible arm-shield, whereby the opposite second-side thereof said arm-shield providing a thermal protective function for direct supporting of hot-plates;

upon completion of hot-plate serving procedure, retracting said flexible arm-shield back into its retracted configuration by removing the wearer's digits from said digit enclosing portions, and aftwardly retracting said arm-shield material again into a compact configuration proximal said wearer's elbow region;

attaching the retracted flexible arm-shield out of the way via the retainer portion, whereby the flexible arm-shield is ready for redeployment or complete removal.

19. A waiter's hot-plate thermal-protection gauntlet according to claim 1 wherein the retainer includes a mating pad on the flexile insulative member and a stow-pad attached to the aftward retention portion, wherein the mating pad and the stow-pad are releasably secured together.

20. A waiter's hot-plate thermal-protection gauntlet according to claim 1 wherein the retracted flexible insulative member is in a rolled configuration.

21. A hot plate holder comprising:

glove portion including a finger pocket and a thermal protective surface covering at least the palm of a user's hand when at least one of the user's digits are inserted into the finger pocket;

forearm portion attached to the glove portion at a first end including a thermal protective surface covering at least a portion of the user's forearm;

strap encircling the user's forearm and attached to a second end of the forearm portion; and retainer releasibly securing the glove portion and the forearm portion in a compact configuration near the strap.

22. A method of protecting a user from burns when carrying hot objects comprising:

attaching one end of a hot plate holder to a user's arm by attaching a strap at a first end of the hot plate holder to the wearer's arm;

inserting at least one of the user's digits into a securing portion at a second end of the hot plate holder, whereby the hot plate holder protects at least a portion of the user's palm and arm from burns;

withdrawing the user's digits from the securing portion of the second end of the hot plate holder;

retracting the hotplate holder into a compact configuration near the strap; and releasably attaching the retracted hotplate holder in its compacted configuration, whereby the hot plate holder is held out of the way when not in use.

23. A method according to claim 22 further comprising:

releasing the attached and retracted hotplate holder from its compact configuration;

re-inserting at least one of the user's digits into the securing portion of the second end of the hot plate holder.

* * * * *